US005361426A

United States Patent [19]

Martin

[11] Patent Number: 5,361,426

[45] Date of Patent: Nov. 8, 1994

[54] HYDRAULICALLY CONTROLLED PRESSURIZED WATER CLOSET FLUSHING SYSTEM

[75] Inventor: Raymond B. Martin, Bloomfield Hills, Mich.

[73] Assignee: W/C Technology Corporation, Troy, Mich.

[21] Appl. No.: 48,482

[22] Filed: Apr. 16, 1993

[51] Int. Cl.[5] ..... E03D 3/10

[52] U.S. Cl. ..... 4/361; 4/359; 4/354; 251/41; 251/43

[58] Field of Search ..... 4/354, 359, 360, 361, 4/362; 137/893, 895; 251/33, 41, 43, 144

[56] References Cited

U.S. PATENT DOCUMENTS

| | | | |
|---|---|---|---|
| 3,677,294 | 7/1972 | Gibbs et al. | 4/354 |
| 3,817,279 | 6/1974 | Larson | 4/360 X |
| 4,233,698 | 11/1980 | Martin | 4/354 |

*Primary Examiner*—Robert M. Fetsuga
*Attorney, Agent, or Firm*—Lyman R. Lyon

[57] ABSTRACT

A pressurized water closet operating system comprises an accumulator vessel having a flush valve assembly mounted internally thereof both of which are connected at all times to a source of water under pressure. A remote control valve hydraulically conditions the flush valve for the discharge of water under pressure from the accumulator vessel.

7 Claims, 3 Drawing Sheets

FIG. 1.

HYDRAULICALLY CONTROLLED PRESSURIZED WATER CLOSET FLUSHING SYSTEM

BACKGROUND OF THE INVENTION

1. Field of the Invention

The present invention relates to an improved pressurized water closet flushing system that minimizes water usage incident to flushing yet maximizes reliability of the system.

2. Related Art

The herein disclosed pressurized water closet flushing system is an improvement over the system disclosed in my U.S. Pat. No. 4,233,698 issued Nov. 18, 1980.

The basic components of a pressurized water closet flushing system are an accumulator vessel, a flush valve and a flush control. The aforesaid components are generally installed internally of a water closet and are energized by water pressure from a fresh water supply system.

As the water level rises in the accumulator vessel, air internally thereof is compressed. When the pressure of the compressed air in the accumulator vessel equals that of the fresh water supply, flow of water into the accumulator vessel ceases and the system is conditioned for operation. When the flush control is actuated, the compressed air in the accumulator vessel pushes the stored water into the water closet bowl at high velocity, flushing waste therefrom with minimum water consumption.

Pressurized water closet flushing systems of the type taught in my aforementioned patent utilize pneumatic control of flush action which has presented a reliability problem. Specifically, low pressure in the fresh water system may result in inconsistent closing of the flush valve. Attempts to solve this problem by modification of the pneumatic control system have not been totally successful.

SUMMARY OF THE INVENTION

The water closet flushing system of the present invention exhibits a substantial improvement in the consistency and reliability of the flushing action without a corresponding increase in water consumption. Utilization of the available potential energy of the compressed air charge in the accumulator vessel is maximized, by instantaneous and rapid opening of the flush valve, while water consumption is minimized by positive closing of the flush valve.

More specifically, the flush valve is mounted on and is controlled by a piston that reciprocates in a flush valve cylinder. The piston divides the flush valve cylinder into upper and lower chambers.

In accordance with one feature of the present invention, the upper chamber of the flush valve cylinder is connected at all times directly to the pressurized fresh water supply.

In accordance with another feature of the invention, the flush control is also connected directly to the upper chamber of the flush valve cylinder. Thus, when the flush control is opened, water pressure in the upper chamber of the cylinder is instantaneously relieved creating a pressure differential across the piston allowing water pressure on the lower face of the piston to immediately bias the piston and flush valve upwardly to the open condition. When the flush valve opens, water in the accumulator vessel is discharged at high velocity into the water closet bowl.

After flush, water flows primarily to the upper chamber of the flush valve cylinder biasing the piston and flush valve thereon downwardly onto its seat to terminate the water discharge phase of the flush cycle. A piston return spring exerts a normal bias on the piston and flush valve thereon to augment the aforesaid piston movement toward the closed condition. Thereafter, water continues to flow into the accumulator vessel until a pressure equilibrium is achieved.

Operation of the aforesaid system is based on the proposition that the cross-sectional area of the water inlet to the upper chamber of the flush valve cylinder is larger than the cross-sectional area of the water inlet to the accumulator vessel. As a result, during refill, water first flows primarily to the upper chamber of the flush valve cylinder affecting a downward bias on the piston that is greater than the upward bias thereon due to the relatively slower pressure buildup within the accumulator vessel. When the upper chamber is filled, all of the water from the supply is diverted into the accumulator vessel. Leakage of water past the flush valve piston due to the pressure differential thereacross during the refill cycle is inherently accommodated by the system since water pressure in the upper chamber of the flush valve cylinder is greater than that in the vessel only until equilibrium is reached. Stated in another manner, the system is essentially fail safe in that leakage or failure of the flush valve's "U" cup seal will only result in leakage of water from the upper chamber of the flush valve cylinder downwardly past the piston during the refill cycle which is of minimum consequence and which will terminate when system equilibrium is achieved. Moreover, even minimum water flow due to low system pressure will effect closure of the flush valve since water is initially directed primarily to the upper chamber of the flush valve.

It is to be noted that the cross-sectional area of the control tube between the upper chamber of the cylinder and the flush control must be at least 50% larger than the cross-sectional area of the water supply tube feeding the upper chamber of the flush valve cylinder. Moreover, the flush control, after opening, must close slowly to allow the accumulator vessel to fully discharge. Because the water inlet to the upper chamber of the flush valve cylinder is relatively larger in diameter than the water inlet to the accumulator vessel, system pressure will initially be achieved in the upper chamber of the flush valve cylinder resulting in closure of the flush valve, prior to the filling of the accumulator vessel and achievement of pressure equilibrium in the entire system.

DETAILED DESCRIPTION OF THE PREFERRED EMBODIMENT OF THE INVENTION

Figure 1:
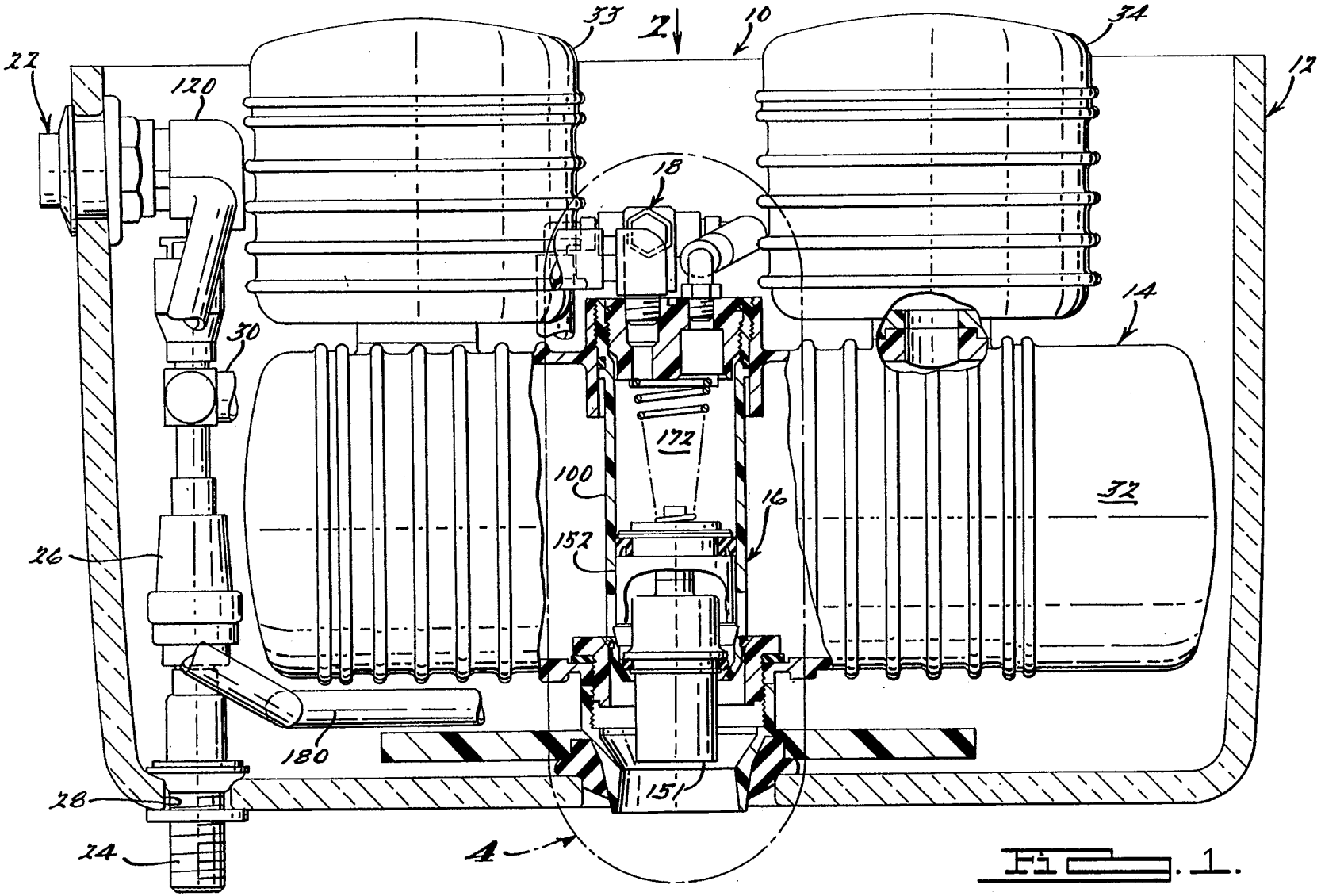
FIG. 1 is an elevational view, partially in section of an improved pressurized water closet flushing system in accordance with the present invention.

Referring to FIG. 1 of the drawings, a pressurized water closet flushing system 10, in accordance with a preferred and constructed embodiment of the present invention, is shown in operative association with a conventional water closet tank 12. Major components of the system 10 are an accumulator vessel 14, a flush valve assembly 16, a water inlet and air induction manifold 18, and a manual flush control valve 22.

Water is supplied to the system 10 from a pressurized source (not shown) through a conventional externally threaded inlet stem 24 of a water inlet tube 26. The inlet stem 24 is disposed in a complementary aperture 28 in the water closet tank 12. Water flows upwardly without restriction through the tube 26 thence laterally through a line 30 (FIG. 2) to the water inlet and air induction manifold 18.

The accumulator vessel 14 is of a size dictated by energy requirements of the system 10. In the constructed embodiment disclosed, the accumulator vessel 14 comprises a cylindrical horizontally orientated primary tank 32 and a pair of vertically orientated top mounted auxiliary tanks 33 and 34.

Figure 3:
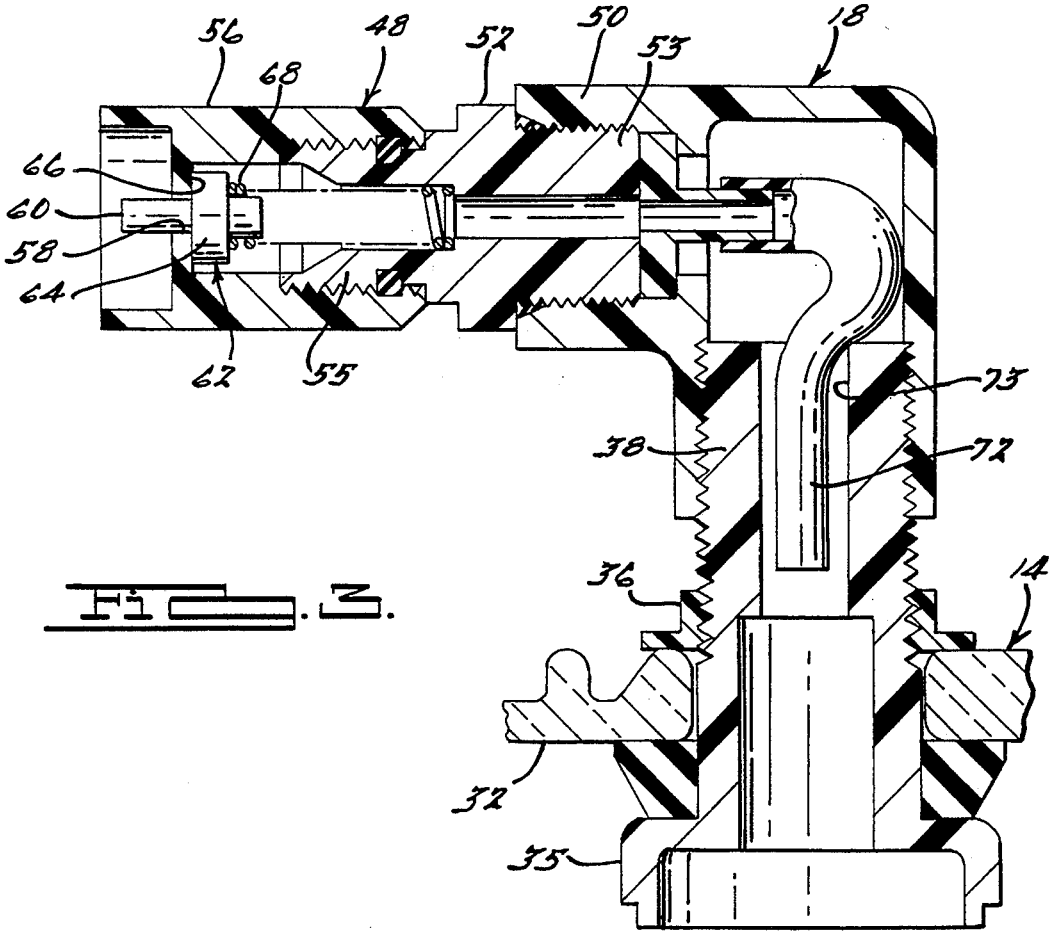
FIG. 3 is a view taken along the line 3—3 of FIG. 2.

As best seen in FIG. 3, the water inlet and air induction manifold 18 is mounted on the primary tank 32 of the accumulator vessel 14. A flanged mounting nipple 35 is retained on the tank 32 by a nut 36. The mounting nipple 35 has an externally threaded upstanding portion 38 for the acceptance of the water inlet manifold 18.

Figure 2:
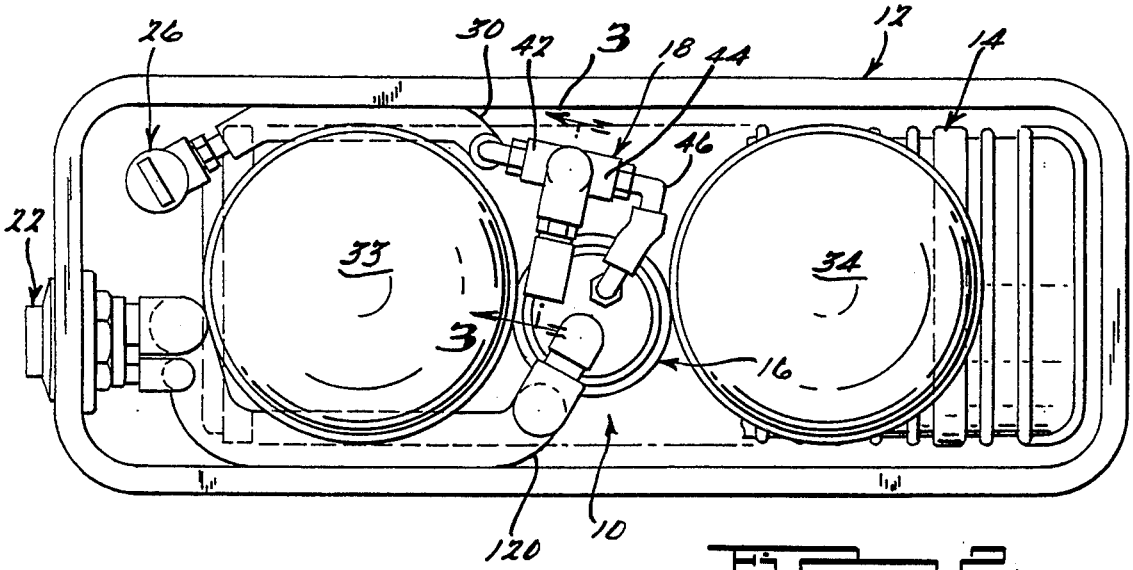
FIG. 2 is a view taken in the direction of the arrow "2" of FIG. 1.

As best seen in FIG. 2, the manifold 18 has a leg portion 42 that accepts the line 30 from the water inlet tube 26 as well as an oppositely directed leg portion 44 that accepts a line 46 leading to the flush valve 16, as will be described. It is to be understood that pressurized water is free to pass through the tube 26, line 30, and inlet manifold 18 to both the flush valve 16 and accumulator vessel 14 at all times under system pressure.

Referring again to FIG. 3, an air induction system generally designed by the numeral 48 is accepted in yet another leg portion 50 of the manifold 18. The air induction system 48 comprises a mounting nipple 52 having an externally threaded stem portion 53 that is accepted in the complementary internally threaded leg portion 50 of the manifold 18. The nipple 52 has a second externally threaded stem portion 55 that accepts a complementary internally threaded cap 56. The cap 56 has an aperture 58 therein for the acceptance of a stem 60 of an air induction valve 62. The valve 62 has a radially extending flange 64 thereon which is normally seated against a complementary seat 66 on the cap 56. The valve 62 is normally biased to the closed position by water pressure within the system. When pressure is reduced in the accumulator 14, as by flush of the system 10, subsequent flow of water into the accumulator 14 opens the valve 62. The valve 62 is free to open, a spring 68 merely acting as a spacer to position the valve 62, for movement when a pressure differential is created thereacross due to inlet flow of water.

A tube 72 extends downwardly through a central passage 73 in the nipple 35 in the direction of water flow into the accumulator vessel 14. When water flow creates an air pressure differential across the valve 62, the valve 62 is biased to the open condition as long as external air pressure is greater than the air pressure internally of the accumulator vessel 14. When the aforesaid pressure differential exists, makeup air is drawn into the inflowing water stream, replenishing air in the accumulator vessel 14 in a self regulating manner.

Figure 4:
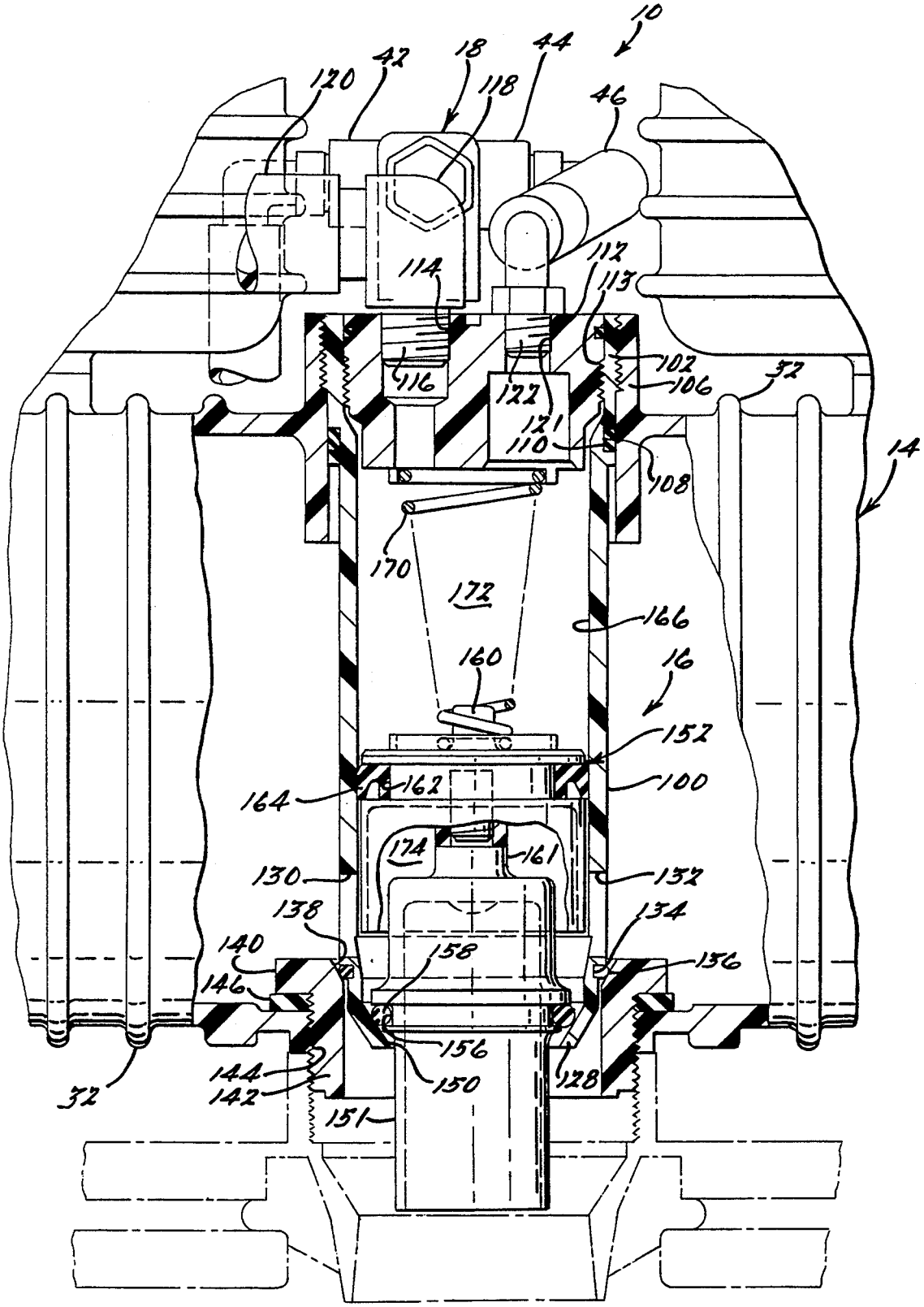
FIG. 4 is an enlarged cross-sectional view taken within the circle "4" of FIG. 1.

In accordance with the present invention, and as best seen in FIG. 4 of the drawings, the flush valve assembly 16 comprises a vertically oriented flush valve cylinder 100 having an externally threaded upper end portion 102 that is accepted in a complementary internally threaded flange 106 on the primary tank 32 of the accumulator vessel 14. The flush valve cylinder 100 is provided with an annular groove 108 for the acceptance of an annular seal 110 that effects a seal between the cylinder 100 and flange 106 of the accumulator vessel 14. The flush valve assembly 16 is removable as a complete assembly from the accumulator vessel 14 by simply rotating the cylinder 100 relative to the accumulator vessel 14 thereby to effect relative vertical movement and release.

The flush valve cylinder 100 is provided with an externally threaded upper end cap 112 that is accepted in complementary internal threads 113 in the upper end portion 102 of the cylinder 100. The end cap 112 has a first internally threaded bore 114 for the acceptance of an externally threaded water outlet nipple 116 of an elbow 118. A relatively large internal diameter tube 120 connects the elbow 118 to the manually operable flush control valve 22 to facilitate flushing of the system 10, as will be described.

The end cap 112 has a second internally threaded bore 121 for the acceptance of a water inlet nipple 122. The nipple 122 is connected to the water inlet manifold 18 by the water line 46.

A lower end portion 128 of the cylinder 100 is provided with a pair of apertures 130 and 132 for the admission of water into the interior of the flush valve cylinder 100 for subsequent discharge from the flush valve assembly 16. The apertures 130 and 132 are disposed immediately above an annular groove 134 in the cylinder 100 which accepts an O-ring 136. The O-ring 136 is seated on a complementary conical seat 138 on a flush valve bushing 140. The bushing 140 has an externally threaded portion 142 that is accepted in a complementary internally threaded aperture 144 in the primary tank 32 of the accumulator vessel 14. A suitable gasket 146 affects a seal between the bushing 140 and accumulator vessel 14. Thus, the lower end 128 of the cylinder 100 is sealed to the accumulator 14.

The lower end portion 128 of the cylinder 100 has an annular truncated conical seat 150 for the seating of a downwardly extending inverted cup portion 151 of a flush valve piston 152. The cup portion 151 of the piston 152 is provided with an annular groove 156 for the acceptance of an O-ring 158 that is normally seated on the annular conical seat 150 of the cylinder 100.

The inverted cup portion 151 of the piston 152 is connected to a head portion 160 thereof by an intermediate neck portion 161. The piston head portion 160 has an annular groove 162 therein for the acceptance of an annular lip seal 164, of U-shaped radial cross section, that effects slidable sealing engagement between the piston 152 and an inside wall 166 of the cylinder 100.

The piston 152 is normally biased downwardly relative to the cylinder 100 to the seated position shown in FIG. 4 by a helical compression spring 170. In this condition, the O-ring 158 on the inverted cup 151 portion of the piston 152 is seated against the annular conical seat 150 on the cylinder 100, sealing the accumulator vessel 14 against the discharge of water therefrom. It is to be noted that the head portion 160 of the piston 152 divides the cylinder 100 into an upper chamber 172 between the head 160 of the piston 152 and the end cap 112 and a lower chamber 174 underlying the head 160.

The flush control valve 22 used to initiate flushing of the system 10 is of conventional construction, for example, a Model 190-0 push button valve obtainable from Mansfield Plumbing Products, Perrysville, Ohio. The valve 22 is connected directly to the upper end cap 112 of the flush valve cylinder 100 through the conduit 120. When opened, the control valve 22 releases the water pressure in the upper chamber 172 of the cylinder 100 instantaneously freeing the piston 152 for movement upwardly due to air and water pressure in the accumulator 14 and lower chamber 174. The outlet of the control valve 22 may be connected by a conduit 180 back to the accumulator vessel 14 at a point below the outlet seal 158 on the inverted cup valve 151 or to the interior of the water closet 12 for venting to the toilet bowl (not shown), thereby to pass any water discharged from the upper chamber 172 of the flush valve 16 directly into the toilet bowl.

It is important to note that a critical relationship exists between the rate of water flow, as dictated by minimum inlet areas and connecting lines, to the accumulator 14, flush valve 16, and control valve 22.

On the assumption that all orifices and lines are circular, the following table sets forth inlet and/or water line diameter ratios found to be operative in a constructed embodiment:

| Accumulator Inlet | Flush Valve Inlet | Control Valve Inlet |
|---|---|---|
| min. .050 | .100 | .125 |
| mean. .090 | .200 | .250 |
| max. .150 | .300 | .375 |

It is important to note that the amount of residual water in the bowl (not shown) after flush can be tuned in relation to bowl size, by selection of the appropriate ratio.

In operation, unrestricted flow of water under system pressure is supplied to the system 10 through the water inlet tube 26, line 30, water and air induction manifold 18, into both the upper chamber 172 of the flush valve cylinder 100 and the accumulator vessel 14. Assuming that the supply inlets to the flush valve 16 and accumulator vessel 14 are of a circular configuration, the supply line to the upper chamber 172 of the flush valve 16 has a larger diameter by a factor of approximately 2 over the supply line to the accumulator 14 to insure that the upper chamber 172 of the cylinder 100 fills first thereby to bias the piston 152 and valve 151 downwardly to the closed condition prior to filling of the accumulator 14. After the upper chamber 172 of the cylinder 100 is filled, and the flush valve 151 closes, the entire water flow is directed into the accumulator vessel 14. As the water level rises in the accumulator vessel 14, air trapped therein is compressed until the pressure thereof equals that of the fresh water supply.

When the flush control 22 is actuated, water pressure in the upper valve chamber 172 above the piston 152 is instantly relieved allowing the piston 152 to move upwardly against the bias of the spring 170 due to the pressure differential across the piston 152. It is important that the inside diameter of the inlet to the control valve 22 and that of the pressure relief tube 120 extending between the upper chamber 172 of the flush valve 16 and the control valve 22 be larger than the diameter of the inlet to the flush valve 16 by a factor of at least 1.25.

As the piston 152 and cup valve 151 thereon move upwardly, water stored in the accumulator vessel 14 is discharged through the apertures 130 and 132 in the cylinder 100 and flows downwardly past the inverted cup valve 151 on the piston 152 and into the water closet bowl. Downward flow of water past the cup valve 151 on piston 152 exerts an upward hydrostatic pressure on the skirt 200 thereof which works against the bias of the piston spring 170 tending to hold the valve 151 in the open condition until the accumulator vessel is emptied. As air in the accumulator vessel 14 expands, and additional air is induced from the air induction assembly 18, the pressure in the vessel approaches atmospheric pressure. The control valve 22 being closed permits the pressure differential across the elevated piston 152 to be reduced allowing the piston 152 to move downwardly under the bias of system water pressure and the spring 170 to effect seating of the O-ring 158 of the valve 151 against the valve seat 150 on the lower end of the cylinder 100, terminating flow of water into the water closet bowl. It is to be noted that the aforesaid operating procedure does not require total exhaust of water from the accumulator vessel 14 but, in contradistinction, termination of flush action is positively controlled by the rate that the pressure differential across the piston 152 is dissipated, which, in turn, is controlled by the relative cross-sectional areas of the water inlets to the flush valve 16 and accumulator 14, as well as the length of time the control valve 22 is open.

After termination of the flush action, the water supply in the accumulator vessel 14 is replenished from the water supply system. Water flows through the inlet tube 26 and line 30 to the water and air induction manifold 18. As water flows past the tube extension 74 in the air induction assembly 18 to the accumulator vessel 14, air is induced into the water stream entering the accumulator vessel 14 to replenish the supply of air therein. Replenishment is self-controlled, due to the fact that when adequate air is introduced into the accumulator vessel 14, compression thereof will effect closure of the valve 62.

From the foregoing it should be apparent that the water closet flushing system of the present invention constitutes an improvement over known systems by providing an efficient, low cost flush valve assembly with positive hydraulically controlled flush valve actuation.

While the preferred embodiment of the invention has been disclosed, it should be appreciated that the invention is susceptible of modification without departing from the scope of the following claims.

I claim:

1. A hydraulically controlled pressurized water closet flushing system comprising:

an accumulator vessel for storing water and air under pressure;

a water outlet from said vessel;

a cylinder extending vertically above the water outlet in said vessel and having a lower end in communication with the water outlet thereof;

a piston in said cylinder defining upper and lower chambers therein;

means for constantly supplying pressurized water concomitantly to said accumulator vessel and to the upper chamber of said cylinder independently of the position of said piston, said means including a water manifold having a first fluid connection to said accumulator vessel and a second relatively larger fluid connection to the upper chamber of said cylinder;

an aperture in said cylinder providing communication between the interior of said accumulator vessel and the lower chamber in said cylinder;

a flush valve on said piston normally closing said water outlet; and a normally closed control valve operable to open fluid communication between the upper chamber in said cylinder and ambient air pressure thereby to create a pressure differential across said piston and effect upward movement thereof and opening movement of said flush valve.

2. The system of claim 1 wherein said control valve is directly connected to the upper chamber of said cylinder by a third fluid connection that is relatively larger than said second fluid connection.

3. The system of claim 2 wherein the minimum fluid orifices between said water manifold and said accumulator vessel, upper cylinder chamber and control valve are circular and exhibit the following diametric ratios:

| Accumulator Inlet | Flush Valve Connection | Control Valve Connection |
|---|---|---|
| min. .050 | .100 | .125 |
| mean. .090 | .200 | .250 |
| max. .150 | .300 | .375 |

4. In a pressurized water closet comprising an accumulator vessel having a water inlet for the admission of water under pressure and a water outlet, an improved hydraulically controlled operating system for controlling the discharge of water from the outlet of said accumulator vessel comprising:

a cylinder vertically oriented above said water outlet and having an annular valve seat at the lower end thereof;

a piston in said cylinder defining upper and lower chambers therein;

a valve on said piston normally seated on the valve seat of said cylinder and closing said water outlet;

an aperture in said cylinder providing communication between the interior of said accumulator vessel and the lower chamber in said cylinder;

means connecting a pressurized water source for concomitant flow to the upper chamber of said cylinder and to the water inlet of said accumulator vessel, said means including a water manifold having a first fluid connection defining said accumulator vessel water inlet and a second relatively larger fluid connection to the upper chamber of said cylinder; and a normally closed control valve in fluid communication with the upper chamber of said cylinder and with the ambient environment and openable to relieve water pressure in the upper chamber thereby to condition said piston for movement to open the valve thereon and effect the discharge of water through the water outlet of said accumulator vessel.

5. The system of claim 4 wherein said connecting means includes means for admitting ambient air into water flowing to said accumulator vessel.

6. In a pressurized water closet operating system energizable by a pressurized water source, an accumulator vessel having a water outlet, a cylinder mounted internally of said accumulator vessel having a normally closed end portion;

a piston in said cylinder defining a closed chamber relative to the interior of said accumulator vessel;

a flush valve controlled by said piston normally closing the water outlet of said accumulator vessel;

means including a water manifold connecting said pressurized water source at all times to both the closed chamber in said cylinder through a cylinder inlet aperture and to said accumulator vessel through a vessel inlet aperture relatively smaller than the cylinder inlet aperture; and a normally closed control valve in fluid communication with the chamber in said cylinder and with the ambient environment and having a fluid pressure relief aperature relatively larger than the cylinder inlet aperture openable to relieve water pressure in said chamber thereby to condition said piston for movement toward the end portion of said cylinder so as to open said flush valve and permit discharge of water from said accumulator vessel.

7. In a pressurized water closet comprising a pressurized water source and an accumulator vessel having a water outlet, an improved system for controlling the discharge of water from said accumulator vessel comprising:

a cylinder having one end connected to the water outlet of said accumulator vessel;

a valve seat at the one end of said cylinder;

a piston in said cylinder defining a first chamber at the one end of said cylinder and a second chamber at an opposite end of said cylinder;

a flush valve on said piston normally seated on the valve seat of said cylinder and closing the first chamber in said cylinder;

means connecting said pressurized water source at all times to the second chamber in said cylinder and to said accumulator vessel for concomitantly supplying water thereto, said means including a water manifold having a first fluid connection to said accumulator vessel and a second relatively larger fluid connection to the second chamber of said cylinder; and a normally closed control valve in fluid communication with the upper chamber of said cylinder and with the ambient environment and openable to relieve water pressure in the second chamber of said cylinder thereby to condition said piston for movement so as to open the flush valve thereon and effect the discharge of water from the water outlet of said accumulator vessel.

* * * * *